US006478079B1

(12) United States Patent
Kato et al.

(10) Patent No.: US 6,478,079 B1
(45) Date of Patent: Nov. 12, 2002

(54) PLATE-FIN TYPE HEAT EXCHANGER AND METHOD FOR MANUFACTURING THE SAME

(75) Inventors: Seiichi Kato, Toyoake (JP); Hisashi Nakashima, Kariya (JP); Akio Ueda, Nagoya (JP); Masakazu Hyodo, Toyota (JP); Fumio Moriyama, Ueda (JP)

(73) Assignees: Denso Corporation, Kariya (JP); Hidaka Seiki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/375,984

(22) Filed: Aug. 16, 1999

(30) Foreign Application Priority Data

Aug. 31, 1998 (JP) ..... 10-246206

(51) Int. Cl.[7] ..... F28D 1/04
(52) U.S. Cl. ..... 165/151; 165/182; 165/181
(58) Field of Search ..... 165/151, 150, 165/182, 181

(56) References Cited

U.S. PATENT DOCUMENTS

| | | | | | |
|---|---|---|---|---|---|
| 855,373 | A | * | 5/1907 | Wilson, Jr. | 165/151 |
| 1,045,267 | A | * | 11/1912 | Dippert | 165/151 |
| 1,971,842 | A | * | 8/1934 | Young | 165/151 |
| 2,079,032 | A | * | 5/1937 | Opitz | 165/151 |
| 2,602,650 | A | * | 7/1952 | Marcotte | 165/151 |
| 2,965,357 | A | * | 12/1960 | Modine | 165/182 |
| 3,182,481 | A | | 5/1965 | Oddy et al. | |
| 3,457,988 | A | * | 7/1969 | Meyerhoff et al. | 257/722 |
| 3,780,799 | A | * | 12/1973 | Pasternak | 165/150 |
| 4,141,411 | A | * | 2/1979 | Kalnin et al. | 165/151 |
| 4,756,361 | A | | 7/1988 | Lesage | |
| 4,830,102 | A | * | 5/1989 | Bakay et al. | 165/182 |
| 4,997,036 | A | * | 3/1991 | Schulze et al. | 165/182 |
| 5,501,270 | A | | 3/1996 | Young et al | |
| 5,611,395 | A | * | 3/1997 | Kang et al. | 165/182 |

FOREIGN PATENT DOCUMENTS

| | | | | |
|---|---|---|---|---|
| DE | 2756941 | * | 6/1979 | 165/182 |
| GB | 235492 | * | 6/1925 | 165/151 |
| GB | 714391 | | 8/1954 | |
| JP | 0089371 | * | 8/1978 | 165/185 |
| JP | A-58-127092 | | 7/1983 | |
| JP | 59-120317 | | 7/1984 | |
| JP | 0162134 | * | 8/1985 | 165/151 |
| JP | 0159095 | * | 7/1986 | 165/151 |
| JP | 63-3180 | | 1/1988 | |
| JP | 404288420 | * | 10/1992 | 165/151 |
| JP | 405106988 | * | 4/1993 | 165/182 |
| JP | 405164487 | * | 6/1993 | 165/151 |

* cited by examiner

*Primary Examiner*—Christopher Atkinson
(74) *Attorney, Agent, or Firm*—Harness, Dickey & Pierce, PLC

(57) ABSTRACT

A recess portion for setting an attachment position is formed in each plate fin at positions adjacent to both longitudinal ends of the plate fins on both upstream and downstream ends in an air flowing direction. Therefore, air passing through the plate fins is disturbed by a standing wall portion of the recess portion around the longitudinal ends of the plate fins. Thus, it can prevent a thermal boundary layer from being expanded in a heat exchanger having the plate fin, and heat-transmission efficiency can be improved in the heat exchanger. As a result, an entire area of the plate fin can be effectively used, thereby improving heat-exchanging capacity of the heat exchanger.

9 Claims, 5 Drawing Sheets

PLATE-FIN TYPE HEAT EXCHANGER AND METHOD FOR MANUFACTURING THE SAME

CROSS-REFERENCE TO RELATED APPLICATION

This application is related to and claims priority from Japanese Patent Application No. Hei. 10-246206 filed on Aug. 31, 1998, the contents of which are hereby incorporated by reference.

BACKGROUND OF THE INVENTION

1. Field of the Invention

The present invention relates to a plate-fin type heat exchanger having plural tubes and plural fins, which can be suitably used as a radiator for cooling a cooling liquid of an internal combustion engine.

2. Description of Related Art

In a conventional plate-fin type heat exchanger, both ends (hereinafter, referred to as "longitudinal ends") of each plate fin in a longitudinal direction of the plate fins have recesses for setting attachment positions of the plate fins when the plate fins are laminated. The recesses are simply provided only for setting the attachment positions, so that each plate fin simply extends from a tube adjacent to a longitudinal end of the plate fin toward the longitudinal end. Therefore, an entire area of each plate fin cannot be effectively used for improving heat-exchanging capacity of the heat exchanger.

SUMMARY OF THE INVENTION

In view of the foregoing problems, it is an object of the present invention to provide a plate-fin type heat exchanger having plural tubes and plural plate fins, in which an entire area of each plate fin can be effectively used for improving heat-exchanging efficiency.

According to present invention, a heat exchanger includes a plurality of plate fins laminated from each other in a lamination direction to have a predetermined clearance between adjacent plate fins, and a plurality of tubes penetrating through the plate fins in the lamination direction. Each of the plate fins has a recess portion for setting an attachment position when the plate fins are assembled, and the recess portion is provided at an end side of each plate fin in a longitudinal direction of the plate fins. A standing wall protruding in the laminating direction is formed on an outer periphery of the recess portion. Thus, air passing through the plate fins is disturbed by the standing wall of the recess portion, thereby preventing a thermal boundary layer from being enlarged. As a result, heat-transmission efficiency is improved, and heat-exchanging capacity is also improved. Further, because the standing wall is formed, flexural rigidity and torsional strength of each plate fin can be improved. Therefore, it can restricted plate fins from being deformed when the plate fins are assembled, and the plate fins can be accurately fixed at predetermined positions. That is, in the present invention, attachment positions of the plate fins can be accurately set by the recess portion when the heat exchanger is manufactured. Further, after the heat exchanger is manufactured, heat transmission efficiency can be improved by the standing wall of the recess portion so that an entire area of each plate fin can be effectively used for improving heat-exchanging efficiency.

Preferably, the standing wall of the recess portion has a wall surface on which air passing through between the plate fins is crossed. Therefore, air passing through the plate fins can be sufficiently disturbed by the standing wall of the recess portion.

More preferably, the standing wall is provided integrally with each plate fin by plastically deforming a part of each plate fin. Therefore, the standing wall of the recess portion is readily formed.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENT

A preferred embodiment of the present invention is described hereinafter with reference to FIGS. 1–7. In the embodiment, a plate-fin type heat exchanger of the present invention is typically applied to a radiator 100. The radiator 100 includes plural plate fins 110 extending in a horizontal direction perpendicular to a flow direction of air, and plural flat tubes 120 extending in an up-down direction. The plural plate fins 110 are laminated in the up-down direction to have a predetermined clearance fp between adjacent two plate fins 110. As shown in FIG. 3, the plural flat tubes 120 in which fluid (e.g., cooling water) flows extend in the up-down direction (i.e., fin lamination direction) to penetrate through the plate fins 110, and are arranged in a line in the horizontal direction.

Each of the plate fins 110 and tubes 120 is made of an aluminum material. The plate fins 110 are connected to outer peripheries of the tubes 120 by expanding the tubes 120 after the tubes 120 are inserted into tube holes 210 formed in the plate fins 110.

Figure 2:
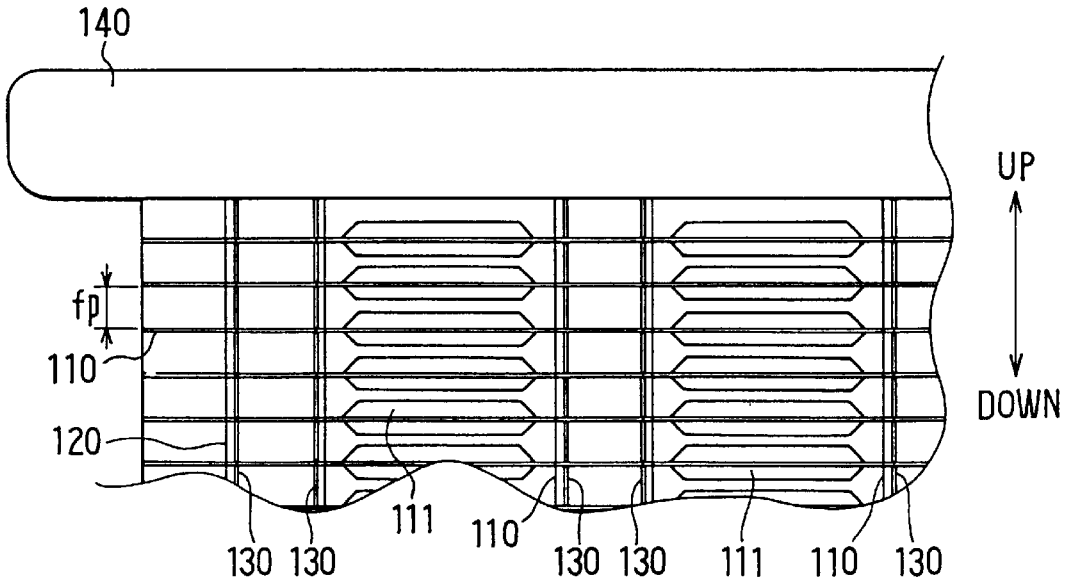
FIG. 2 is a partial front view showing tubes and plate fins of the radiator according to the embodiment.
Figure 3:
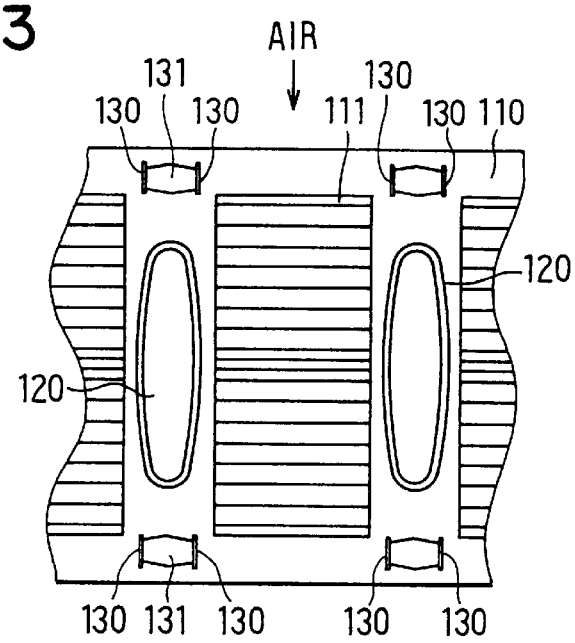
FIG. 3 is a partial plan view showing the plate fin according to the embodiment.

As shown in FIGS. 2, 3, louvers 111 for improving heat-exchanging efficiency are formed in the plate fins 110 between adjacent tubes 120. A part of each plate fin 110 is cut to stand so that the louvers 111 are formed integrally with each plate fin 110. Protrusion pieces 130 protrude from each plate fin 110 to protrude toward one side in the lamination direction (i.e., longitudinal direction of tube) of the plate fins 110. A part of each plate fin 110 is cut to stand so that the protrusion pieces 130 are formed integrally with each plate fin 110.

Top ends of the protrusion pieces 130 protruding from a plate fin 110 contact an adjacent plate fin 110 so that a predetermined clearance fp is formed between adjacent plate fins 110. That is, the protrusion pieces 130 are used as a clearance holding member for holding the predetermined clearance fp. Because the protrusion pieces 130 are formed by cutting the plate fins 110, a hole 131 is formed in the plate fins 110.

Figure 4A:
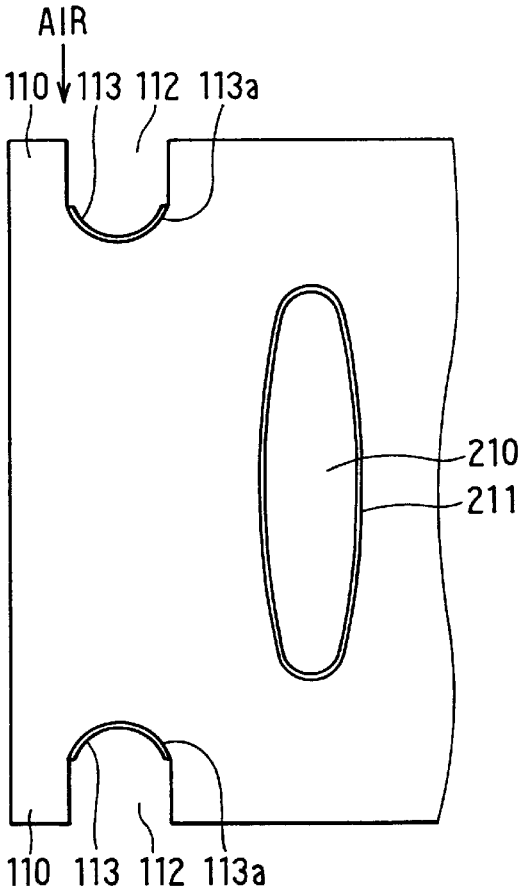
FIGS. 4A, 4B are enlarged front view and side view of the plate fin, respectively, according to the embodiment.

As shown in FIG. 4A, U-shaped recess portions 112 for setting the attachment position of the plate fins 110 are formed on both upstream and downstream ends in an air flowing direction, at both longitudinal end sides of each plate fin 110. On the longitudinal end sides of each plate fin 110, the louvers 111 are not provided. Standing wall portions 113 are formed on bottom portions of recess portions 112 to protrude toward one side of the lamination direction of the plate fins 110. In the embodiment, the standing wall portions 113 protrude in the same direction as the protrusion direction of the protrusion pieces 130.

Figure 4B:
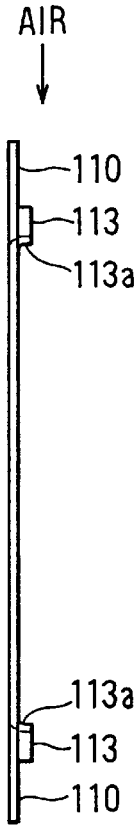

Each of the standing wall portions 113 has a circular arc-shaped wall surface 113*a* so that air passing through the plate fins 110 is disturbed by the wall surface 113*a*. In FIGS. 4A, 4B, the standing wall portions 113 are formed in each plate fin 110 on both upstream and downstream air ends at both longitudinal end sides of each plate fin 110. However, the standing wall portions 113 can be formed in each plate fin 110 at least on the upstream air end.

In the embodiment, the standing wall portion 113*a* is formed by a burring step. That is, a part of the plate fin 110 is plastically deformed by burring so that the standing wall portion 113 is formed. For example, during the burring, a peripheral wall portion of a hole formed in a plate is expanded by a tool, so that a standing wall portion protruding from the plate is formed around the hole.

Figure 1:
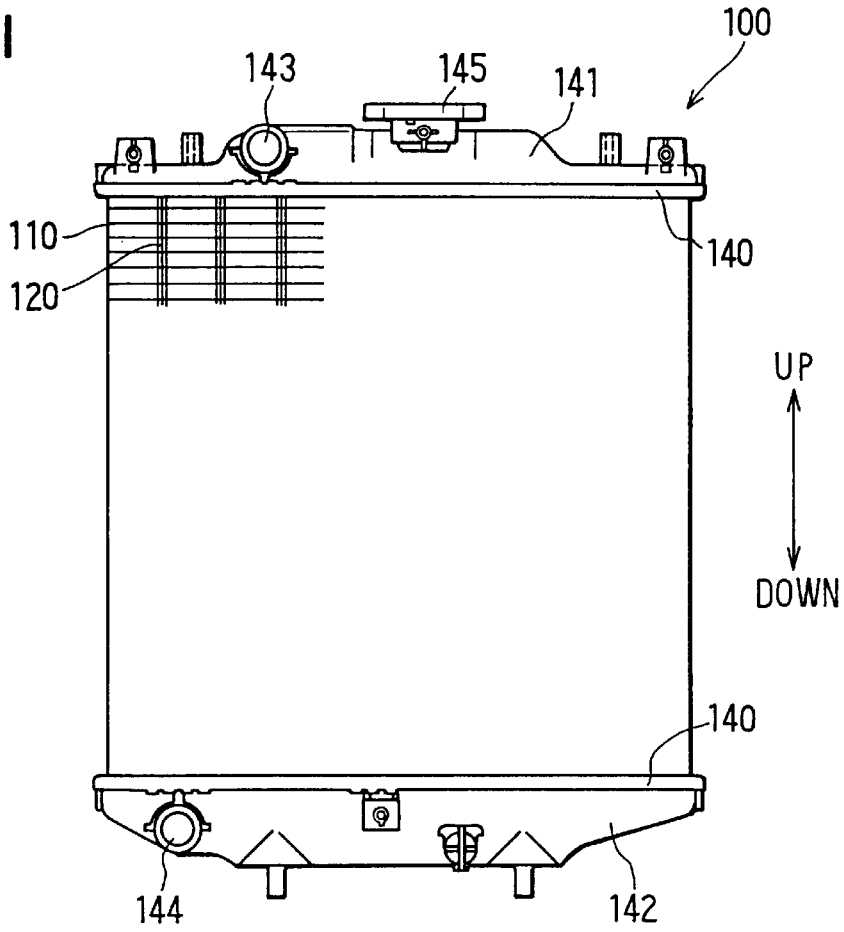
FIG. 1 is a front view showing a radiator according to a preferred embodiment of the present invention.

As shown in FIG. 1, a core plate 140 made of an aluminum material is connected to both ends of each tube 120. The core plate 140 is connected to the tubes 120 by expanding the tubes 120 after the tubes 120 are inserted into holes formed in the core plate 140. Cooling water in an upper tank 141 made of resin is distributed into each tube 120, and is corrected into a lower tank 142 made of resin after being heat-exchanged with air. Both of the upper and lower tanks 141, 142 are fastened and fixed to the core plate 140 through a seal member such as a packing by plastically deforming a protrusion of the core plate 140.

An inlet 143 is formed in the upper tank 141, and is coupled to a cooling water outlet of the engine. An outlet 144 is formed in the lower tank 142, and is coupled to a cooling water inlet of the engine. The upper tank 141 has a hole through which cooling water is introduced into the upper tank 141, and the hole is closed by a cap 145.

Figure 5A:
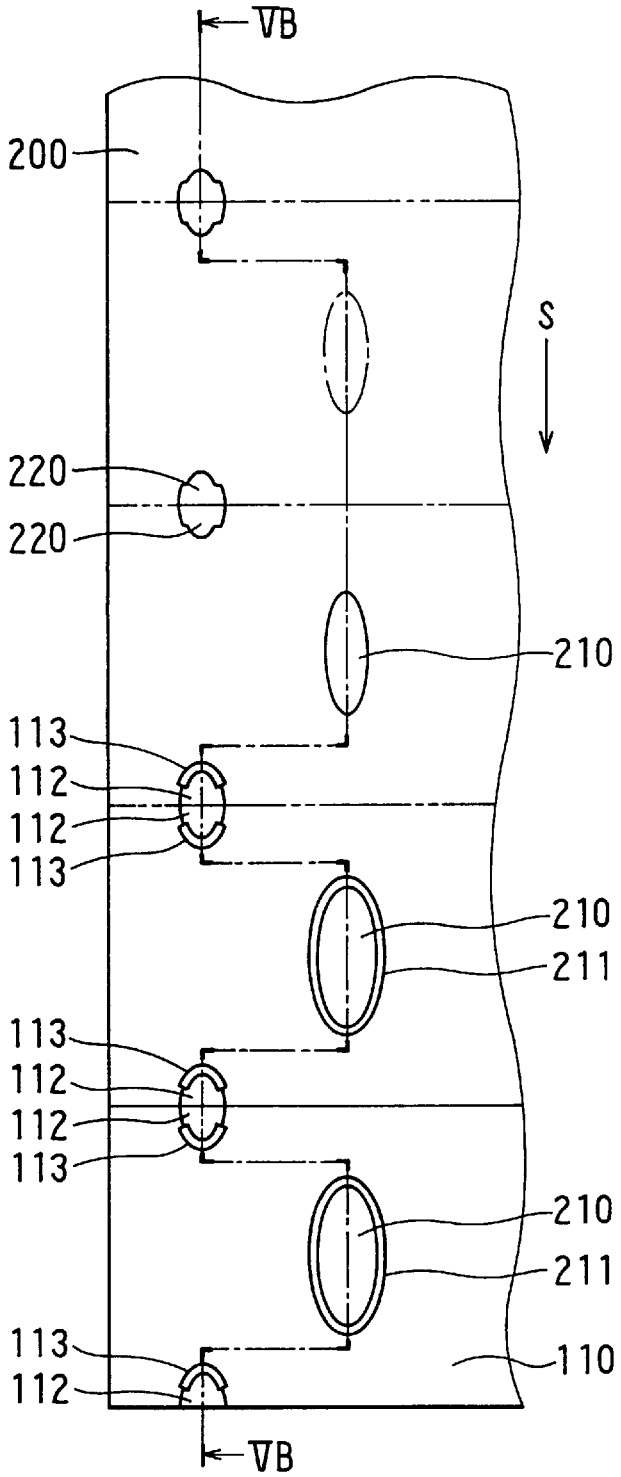
FIG. 5A is a schematic view for explaining a step for forming a fin element.
Figure 5B:
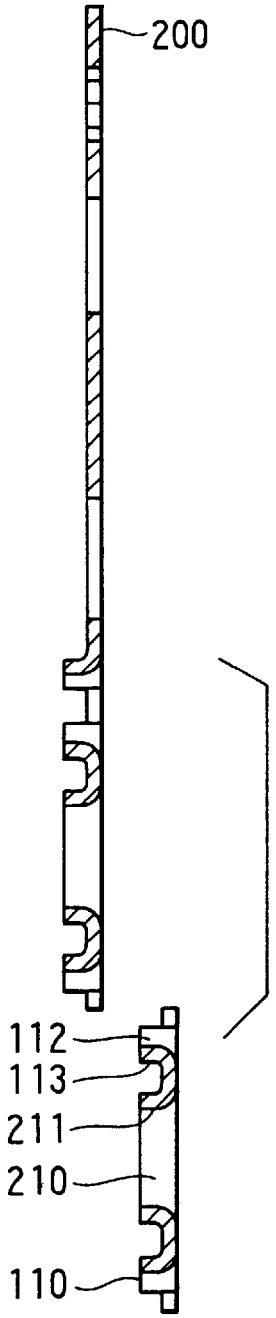
FIG. 5B is a cross-sectional view taken along line VB—VB in FIG. 5A.

Next, a method for manufacturing the plate fin 110 will be now described with reference to FIGS. 5A, 5B. In FIG. 5A, the longitudinal direction of each plate fin 110 is in a width direction perpendicular to a sending direction S of a film-like fin material 200. As shown in FIG. 5A, while the fin material 200 is sent in the sending direction S, the tube insertion holes 210 into which the tubes 120 are inserted and holes 220 corresponding to holes of the recess portions 112 are simultaneously formed by pressing. Further, while the fin material 200 is sent in the sending direction S, burring are performed relative to the holes 220 and the tube holes 210 so that the standing wall portions 113 and wall portions 211 around the tube holes 210 are simultaneously formed in the fin material 200 to protrude toward the same direction. Thereafter, the fin material 200 is cut to have a predetermined length so that each plate fin 110 is formed.

Figure 6:
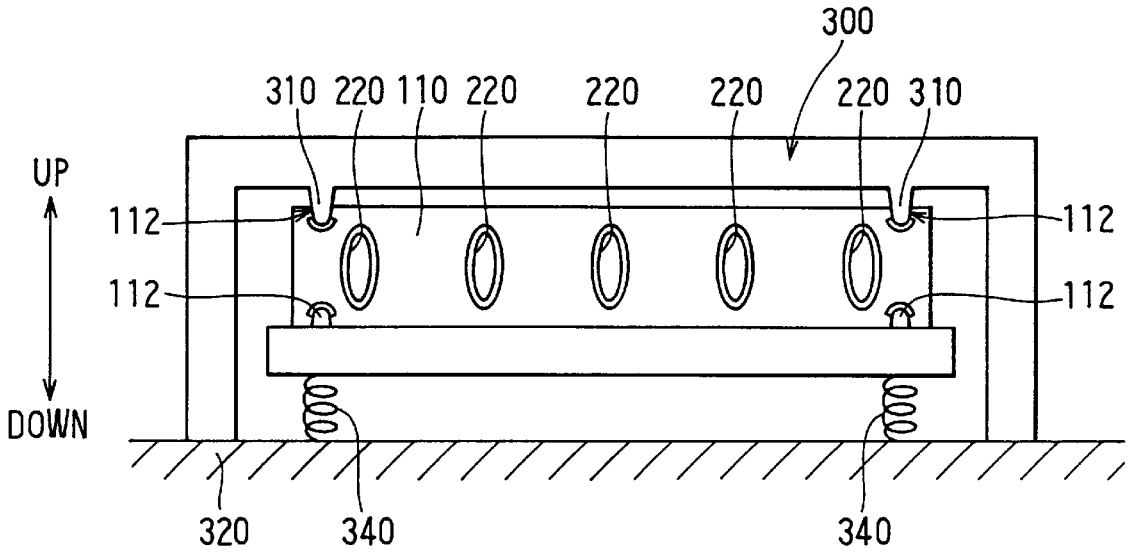
FIG. 6 is a front view of a fixing tool.
Figure 7:
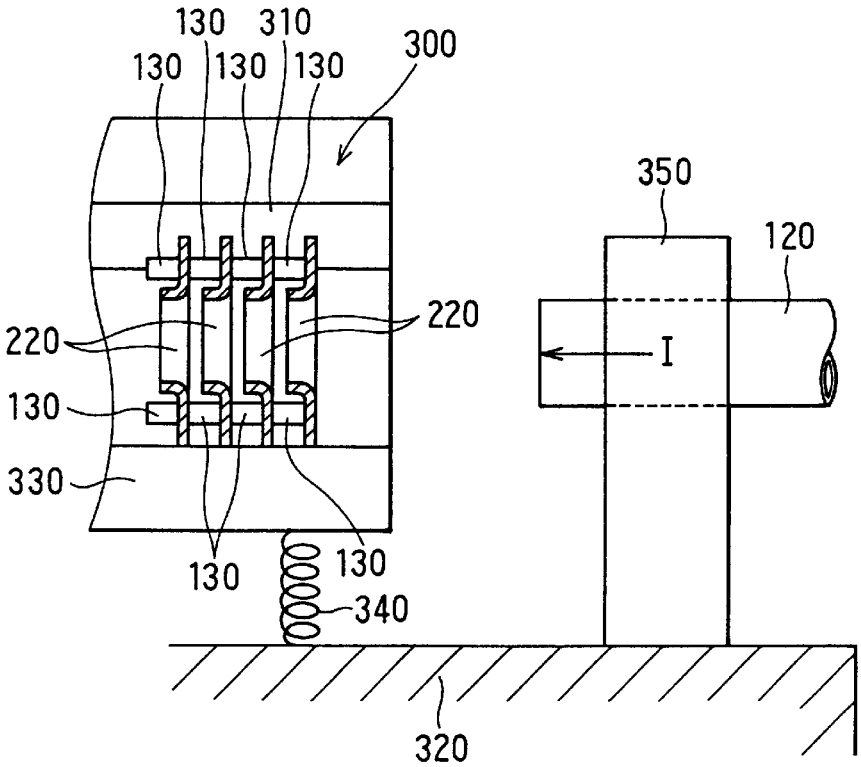
FIG. 7 is a side view of the fixing tool.
Figure 8A:
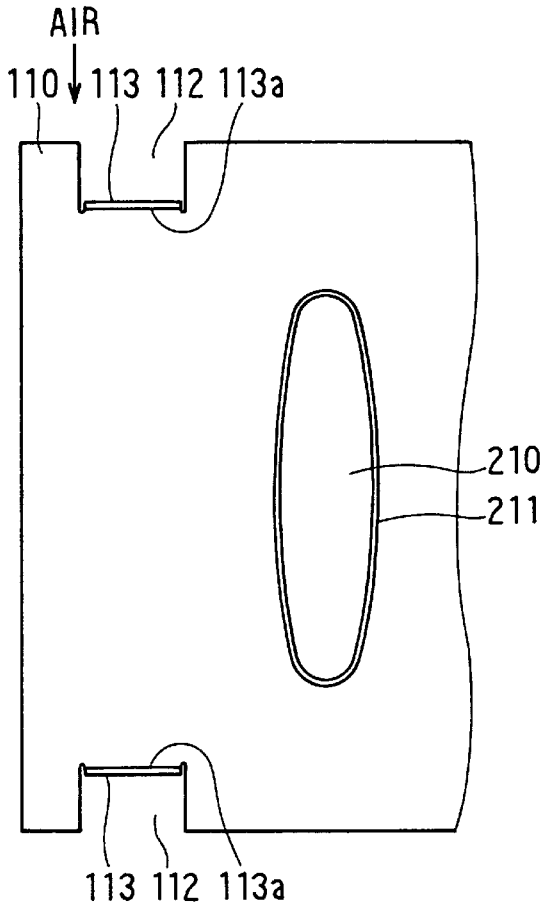
FIGS. 8A, 8B are enlarged front view and side view of a plate fin, respectively, according to a modification of the present invention.
Figure 8B:
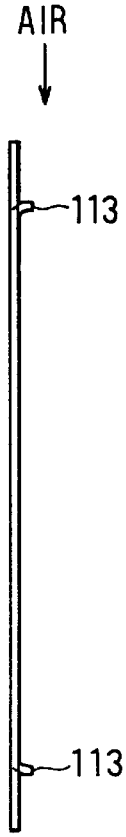
Figure 9A:
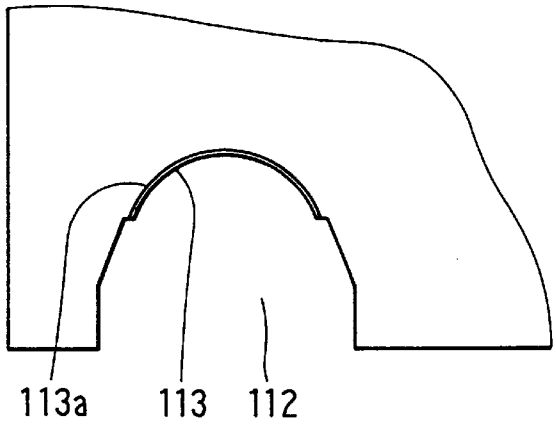
FIGS. 9A, 9B are enlarged front view and side view of a plate fin, respectively, according to an another modification of the present invention.
Figure 9B:
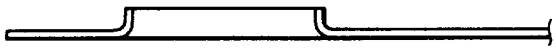

Next, a method for manufacturing the radiator 100 will be now described with reference to FIGS. 6, 7. As shown in FIG. 6, a fixing tool 300 has two protrusion portions 310 for setting the attachment position of each plate fin 110, and the two protrusion portions 310 are inserted into two recess portions 112, respectively, which are positioned at an upper side in FIG. 6 within recess portions 112 formed at both longitudinal end sides of each plate fin 110. Further, as shown in FIG. 7, each top end of the protrusion pieces 130 contacts an adjacent plate fin 110 while the standing wall portions 113 contact the protrusion portions 310 of the fixing tool 300, so that all the plate fins 110 are laminated in the lamination direction. The protrusion portions 310 of the fixing tool 300 extend in a rail like in the lamination direction of the plate fins 110. The upper side of the fixing tool 300 in FIG. 6, where the protrusion portions 310 are provided, is fixed to a base holder 320. On the other hand, the lower side of the fixing tool 300 in FIG. 6, opposite to the protrusion portions 310, is pressed by a coil spring 340 through a fin holder 330, so that the plate fins 110 is pressed toward the protrusion portions 310 of the fixing tool 300.

Next, as shown in FIG. 7, each tube 120 is inserted into each tube hole 210 to penetrate through the plate fins 110, during a tube insertion step. Because each tube 120 has the same shape, a connection method is explained by only using a single tube 120. When the tube 120 is inserted into the tube hole 210, the tube 120 is guided by a guiding member 350. Thereafter, an expanding member such as a metal rod is inserted into the tube 120 to expand the tube 120 so that the outer wall of the tube 120 is press-fitted to the standing wall portion 211, thereby connecting the plate fins 110 and the tube 120 during a fin connecting step.

Next, the core plate 140 is disposed at both ends of each tube 120 in the longitudinal direction, and both ends of each tube 120 are inserted into the tube-insertion holes formed in the core plate 140. The inserted both ends of each tube 120 are expanded again, so that the core plate 140 and the tubes 120 are connected during a core plate connection step.

Thereafter, a core portion which is formed by connecting the plate fins 110, the tubes 120 and the core plate 140 is removed from the fixing tool 300, and the upper and lower tanks 141, 142 are fastened to the core plate 140.

According to the embodiment of the present invention, the standing wall portion 113 is formed on an outer peripheral portion of the recess portion 112 for setting the attachment position, air passing through the plate fins 110 is disturbed by the standing wall portion 113. Thus, it can restrict a thermal boundary layer from being enlarged, thereby improving heat-transmission efficiency and heat-exchanging capacity (e.g., cooling capacity). That is, the recess portions 112 are provided in each plate fin 110 on both longitudinal end sides where the louvers 111 are not provides, and the standing wall portions 113 are provided in the recess portions 112. Therefore, heat-exchanging efficiency of the radiator 100 can be improved by the standing wall portion 113. According to experiments by the inventors of the present invention, the heat-exchanging capacity of the radiator 100 is improved by about 1–2%, as compared with a radiator without the standing wall portion 113.

Further, because the standing wall portion 113 is formed, flexural rigidity and torsional strength of each plate fin 110 are improved. Therefore, when the plate fins 110 are fixed by using the protrusion portions 310, it can restrict the plate fins 110 from being deformed, and the plate fins 110 can be accurately attached at predetermined positions, respectively.

Due to the recess portion 112, the attachment position of each plate fin 110 can be accurately set during a manufacturing step. On the other hand, because air passing through the plate fins 110 is disturbed by the standing wall portions 113 of the recess portions 112, heat-transmission efficiency is improved so that an entire area of the plat fins 110 can be effectively used. As a result, heat-exchanging capacity is improved in the radiator 100.

Further, the standing wall portions 113 and the standing wall portions 211 for the tubes 120 are simultaneously formed by burring in the manufacturing step of the plate fins 110. Therefore, a relative position between the recess portions 112 and the tube holes 210 can be accurately set. Thus, when the plate fins 110 are fixed to the fixing tool 300, the tubes 120 can be accurately inserted into the tube insertion holes 220, respectively.

Although the present invention has been fully described in connection with the preferred embodiment thereof with reference to the accompanying drawings, it is to be noted that various changes and modifications will become apparent to those skilled in the art.

For example, the shape of the recess portions 112 can be changed as shown in FIGS. 8A, 8B, 9A, 9B. In the above-described embodiment, each of the recess portions 112 has an approximate U-shape. However, each of the recess portions 112 may be formed into a rectangular shape shown in FIG. 8A, or may be formed into a shape shown in FIG. 9A.

In the above-described embodiment, the recess portion 112 is formed at the upstream and downstream ends of the plate fin 110 in the air flowing direction on both longitudinal end sides of the plate fin 110. However, the recess portion 112 may be provided at least at the upstream end of the plate fin 110 on both longitudinal end sides of the plate fin 110.

Further, the present invention may be applied to any the other plate-fin type heat exchanger. In the above-described embodiment, the plate fin 110 is press-fitted to the protrusion portions 310 of fixing tool 300 by the coil spring 340. However, instead of the coil spring 340, the other press-fitting member may be used. Further, the fin connection step and the core plate connection step may be performed in a single connection step.

Such changes and modifications are to be understood as being within the scope of the present invention as defined by the appended claims.

What is claimed is:

1. A heat exchanger for performing heat-exchange between first fluid and second fluid, said heat exchanger comprising:

a plurality of plate fins laminated from each other in a laminating direction to have a predetermined clearance between adjacent plate fins, the first fluid passing through said clearance; and a plurality of tubes in which the second fluid flows, said tubes penetrating through said plate fins in the laminating direction, wherein:

each of said plate fins has a recess portion for setting an attachment position when said plate fins are assembled, said recess portion being provided at an end side of each plate fin in a longitudinal direction of said plate fins;

each of said plate fins has a first edge at an upstream side and a second edge at a downstream side in a flow direction of the first fluid perpendicular to the longitudinal direction of said plate fins;

said recess portion has a standing wall protruding in the laminating direction, on an outer periphery of said recess portion;

said standing wall being located interior to one of said first and second edges;

said recess portion has a recess extending from at least one end of said first end and said second end to an inner side of each plate fin;

said recess is provided at a predetermined position in each plate fin, the predetermined position is the same on each of said plate fins in such a manner that said recesses in said plate fins are overlapped and are aligned in the laminating direction; and said recess and said standing wall are offset from all of said plurality of tubes in a direction perpendicular to the flow direction of said first fluid through said heat exchanger.

2. The heat exchanger according to claim 1, wherein said recess portion is recessed from said first end.

3. The heat exchanger according to claim 1, wherein said recess portion is provided on both sides of said first and second ends of each plate fin.

4. The heat exchanger according to claim 1, wherein said standing wall of said recess portion has a wall surface on which air passing through said clearance is crossed.

5. The heat exchanger according to claim 4, wherein said standing wall has an approximate circular arc-shape.

6. The heat exchanger according to claim 1, wherein said standing wall is provided integrally with each of said plate fins by plastically deforming a part of each plate fin.

7. The heat exchanger according to claim 1, wherein said recess portion is provided at both end sides of each plate fin in the longitudinal direction of said plate fins.

8. The heat exchanger according to claim 1, wherein said standing wall of said recess portion provided in one of said plate fins contacts another plate fin adjacent to the one of said plate fins.

9. The heat exchanger according to claim 1, wherein each of said plate fins has a plurality of louvers provided between adjacent tubes.

* * * * *